US008083110B2

(12) United States Patent
Wilkens

(10) Patent No.: US 8,083,110 B2
(45) Date of Patent: Dec. 27, 2011

(54) AID FOR PULLING ON STOCKINGS

(76) Inventor: Claus-Dieter Wilkens, Bremen (DE)

( * ) Notice: Subject to any disclaimer, the term of this patent is extended or adjusted under 35 U.S.C. 154(b) by 1039 days.

(21) Appl. No.: 11/963,337

(22) Filed: Dec. 21, 2007

(65) Prior Publication Data

US 2008/0185407 A1 Aug. 7, 2008

(30) Foreign Application Priority Data

Dec. 23, 2006 (DE) ..... 10 2006 061 485

(51) Int. Cl.
*A47G 25/80* (2006.01)

(52) U.S. Cl. ..... 223/111

(58) Field of Classification Search ..... 223/111–112, 223/1, 120

See application file for complete search history.

(56) References Cited

U.S. PATENT DOCUMENTS

| | | | | |
|---|---|---|---|---|
| 4,284,216 | A * | 8/1981 | Leland | 223/111 |
| 4,765,520 | A * | 8/1988 | Barton | 223/111 |
| 4,942,988 | A * | 7/1990 | Doorenbos | 223/111 |
| 5,082,154 | A | 1/1992 | French | |
| 5,593,071 | A | 1/1997 | Lusk | |
| 5,630,534 | A * | 5/1997 | Maier et al. | 223/112 |
| 5,924,610 | A * | 7/1999 | Willemin | 223/112 |
| 7,350,679 | B2 * | 4/2008 | Radtke et al. | 223/84 |
| 7,364,056 | B2 * | 4/2008 | Boaron | 223/111 |
| 2007/0145086 | A1 * | 6/2007 | Perez | 223/111 |

FOREIGN PATENT DOCUMENTS

| | | |
|---|---|---|
| CH | 343094 | 1/1960 |
| DE | 10314652 A1 | 10/2004 |
| EP | 0332837 A1 | 9/1989 |
| FR | 2785783 A1 | 5/2000 |

OTHER PUBLICATIONS

European Search Report dated Mar. 13, 2008.

* cited by examiner

*Primary Examiner* — Shaun R Hurley
*Assistant Examiner* — Andrew Sutton
(74) *Attorney, Agent, or Firm* — Browdy and Neimark, PLLC

(57) ABSTRACT

An aid for pulling on stockings, especially compression stockings, comprising two parallel first struts, which are spaced mutually apart and each have a free upper end, and two parallel second struts, which are spaced mutually apart and whose upper ends are connected by an arcuate hoop, characterized in that the second struts are mounted such as to be pivotable about a pivot axis together with the hoop connected to them, said pivot axis running transversely to a longitudinal direction of said second strut, said second struts being movable into a first position, in which they are disposed adjacent to said first struts, and a second position, in which they are disposed at a V-shaped angle ($\alpha$) to said first struts.

11 Claims, 4 Drawing Sheets

AID FOR PULLING ON STOCKINGS

FIELD

The invention relates to an aid for pulling on stockings, especially compression stockings, comprising two parallel first struts, which are spaced mutually apart and each have a free upper end, and two parallel second struts, which are spaced mutually apart and whose upper ends are connected by an arcuate hoop, of the type known from EP 0 332 837 B1, for example.

BACKGROUND

Pulling on compression stockings, whether with an open or closed toe, usually causes considerable difficulties. Because of the powerful gripping effect of the stockings, especially in the foot area, which is basically desirable, it is in practice only possible to "roll" the stockings up after they have first been turned "inside out". This process is extremely laborious.

One known possibility is to use understockings to help them slide on. These understockings possess the disadvantage, however, that they have to be removed again after the compression stockings have been put on, so that their use is a priori only possible in the case of compression stockings with an open toe.

In addition, aids for pulling on stockings are known from FR-A-2 501 492 or FR-A-2 315 235, for example. These aids, too, are generally awkward and laborious to handle, however, especially if the mobility of the foot is restricted, so that it can only be partially stretched.

The problem of the invention is to provide an aid for pulling on stockings, especially compression stockings, which makes the action of pulling on the stockings easier, particularly if the mobility of the foot is reduced.

SUMMARY

In an aid of the generic type, this problem is solved in accordance with the invention by the measure that the second struts are mounted such as to be pivotable about a pivot axis together with the hoop connected to them, the pivot axis running transversely to a longitudinal direction of the second struts, the second struts being movable into a first position, in which they are disposed adjacent to the first struts, and a second position, in which they are disposed at a V-shaped angle to the first struts.

It can be provided that the first struts are spaced 6 cm to 15 cm apart from one another, and it is possible for the same to apply to the second struts.

The first struts are preferably attached at their lower ends to a base frame of the aid. The base frame can be U or C-shaped.

The first struts are conveniently arranged to be sloping at an angle of about 90° to 60° to the base frame.

It is appropriate for handles to be disposed on the base frame. Each handle can be designed in the form of an elongate, reverse U-shaped hoop, which extends from the base frame.

Third struts may be disposed spaced apart from the second struts, which, together with the second struts, form longitudinal edges of a tunnel-shaped portion.

It may be advantageous for a releasable locking means to be provided for locking the second struts in the first position. The locking means may have an operating grip, which is conveniently disposed in the region of a handle.

BRIEF DESCRIPTION OF THE DRAWINGS

Further features and advantages of the invention will become clear from the following description, in which one embodiment of the invention is illustrated with reference to a drawing, in which FIGS. 1 and 2 each show a perspective view of an aid in accordance with the invention, from the front and from the rear.

DETAILED DESCRIPTION

Figure 1:
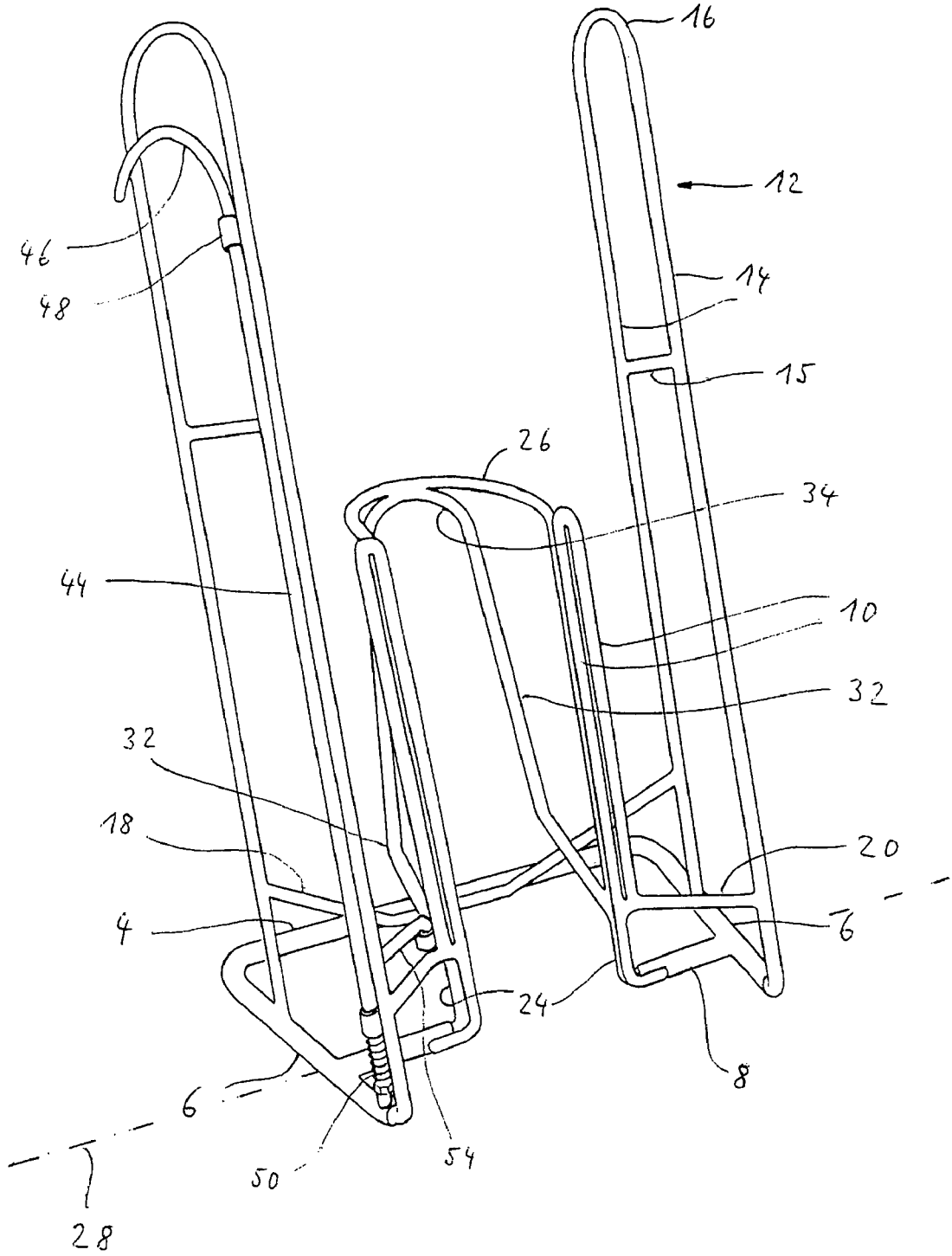

The aid for pulling on stockings in accordance with the invention has a substantially C-shaped base frame 2 with a base leg 4 and two side legs 6, which lie in a base plane 7 and with which the apparatus can be placed on a flat surface. Protruding from the side legs 6, aligned towards one another and running towards one another, are two retaining projections 8, which, at their free ends, support two first struts 10, which are parallel to one another, and are in each case formed in pairs and are connected in a U-shape, spaced apart from one another by a distance d.

In the following, "top" or "upper" means a greater distance from the base plane than "bottom" or "lower", i.e. as usually applied to an everyday article placed on the floor.

Attached to the side legs 6 are elongate, handles 12 in a reverse U-shape, which consist, in the embodiment illustrated, of two parallel, spaced-apart struts 14, which are connected together by a cross-strut 15 and an arcuate portion 16.

The side leg 6 and also the handles 12 are disposed not parallel to one another, but at an ergonomic angle β of, for example, 10° to 20° to one another, so that a user can grip the handles 12 with both hands at a comfortable gripping angle.

In order to improve the stability, the handles 12 are connected in their lower region to the base leg 4 of the base frame by reinforcement struts 18 and to the first struts 10 via further reinforcement struts 20.

Second struts 24 are disposed parallel to one another and immediately adjacent to the first struts 10 and are connected to one another at the level of the free, upper ends of the first struts 10 by an arcuate—in this example approximately semicircular—hoop 26, which is disposed at an angle of, for example, 6° (FIG. 4) to the base plane 7 or can be parallel to the latter.

In the region of a lower end portion of the first struts 10, in this case in the region where they are attached to the retaining projections 8, the second struts 24 are mounted on the base frame 2 such as to be pivotable about a pivot axis 28 running transversely to the first struts 10. In the example illustrated, the pivot axis 28 runs in alignment with the retaining projections 8 and in the base plane 7, the retaining projections 8 being designed in the form of a hollow cylinder or sleeve-like at its ends facing away from the side legs 6 and receiving end portions 30 of the second struts 24 bent in opposite directions. First of all, this method of mounting is easy to achieve from the technical point of view, and secondly it is easy to assemble, since the second struts 24 can be pressed together elastically in the region of the bent end portions and inserted into the ends—which are in the form of hollow cylinders—of the retaining projections 8 when they spring back.

Third struts 32, which run substantially parallel or at a slight angle to the second struts 24 and spaced apart from them, are connected at the top to the hoop 26 via an arcuate portion 34 and, at their opposite ends, to the second struts 24 near their lower ends via bent portions 38.

The second and third struts thus form edge lines of a tunnel-shaped or semicylindrical, or slightly tapering or slightly conical region.

Figure 4:
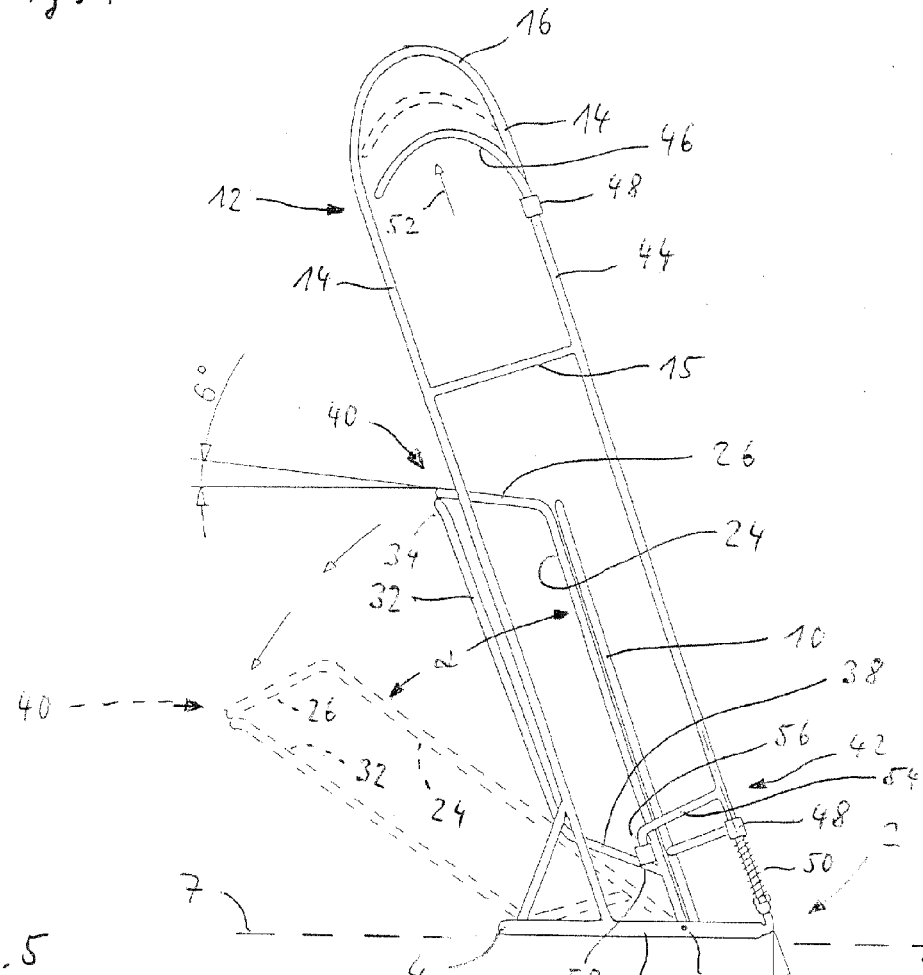
FIG. 4 shows a side view of the aid.
Figure 5:
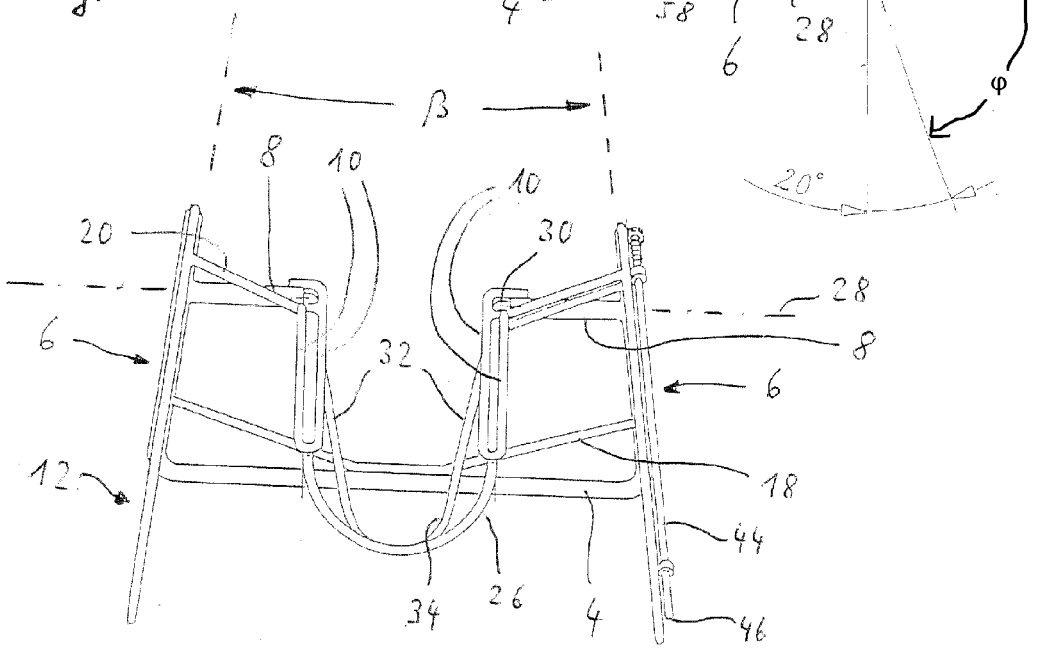
FIG. 5 shows a view of the aid according to FIGS. 1 to 4, seen from above.

Because of the pivotable mounting about the pivot axis 28, the second and third struts 24, 32 and the hoop 26 form a pivot portion 40, which can be moved about the pivot axis 28 within an angle range indicated by α in FIG. 4, where a position in which the first struts 10 are folded down is shown by dashed lines.

In the embodiment illustrated, all the struts 10, 24, 32 and 14 are parallel to one another (32 approximately) and are disposed so as to be inclined at an angle ϕ of approx. 70° to the base plane 7.

In order to hold the pivot portion 40 in its position folded up against the first struts 10, a locking means 42 is provided, which, in the example illustrated, has an operating rod 44, one end of which is bent into a lever 46. The shape and size of the lever 46 are adapted to an arcuate portion 16 of a handle 12.

The operating rod 44 is guided in guide sleeves 48 which are attached to a strut 14 so as to be displaceable in the longitudinal direction and are biased in a locked position by a compression spring 50 contrary to a release direction 52.

A locking arm 54 connected to the operating rod 44 is bent at its free end into a locking projection 56, which engages in a locking sleeve 58 attached to a second strut 24.

Figure 2:
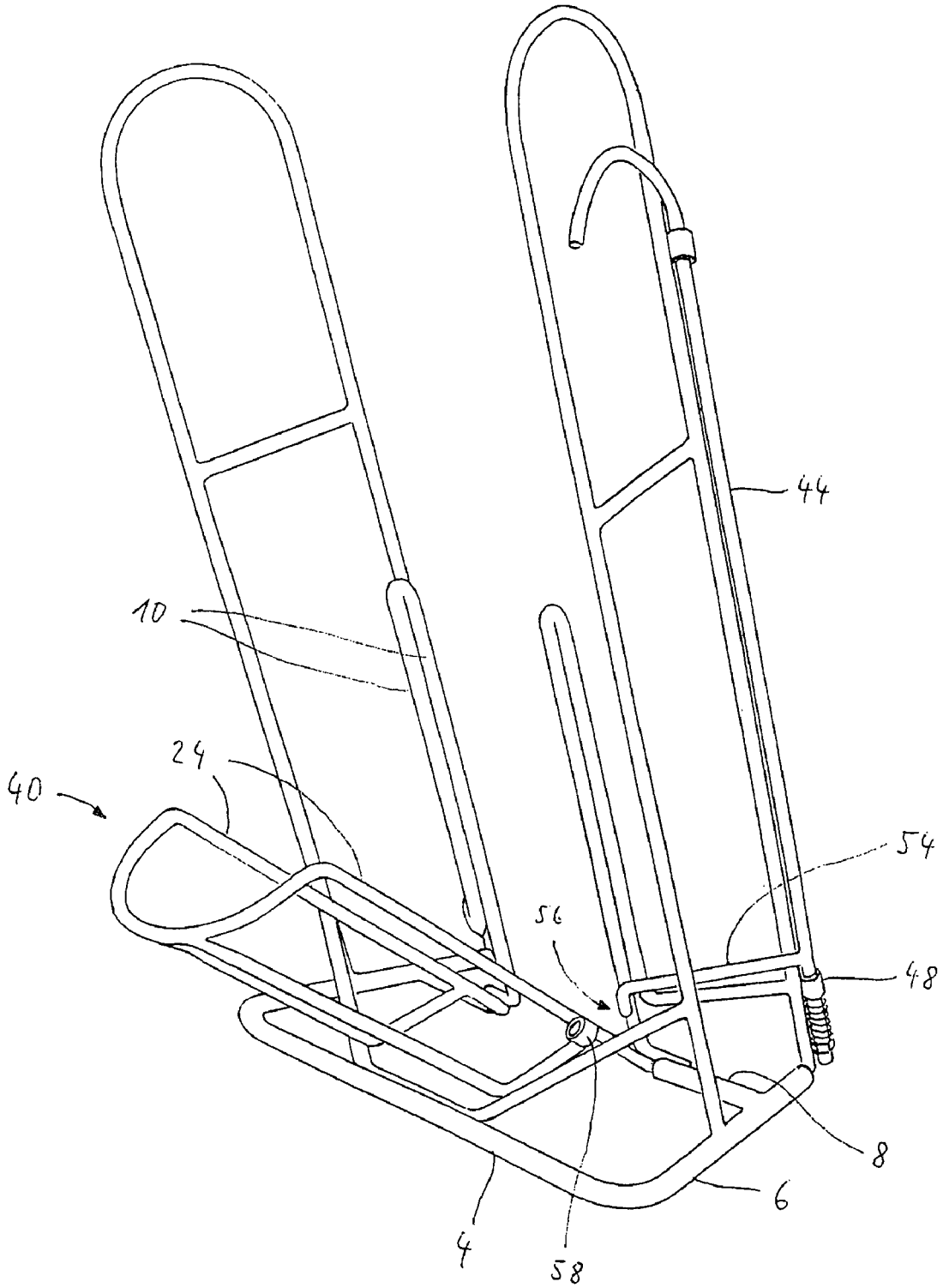
Figure 3:
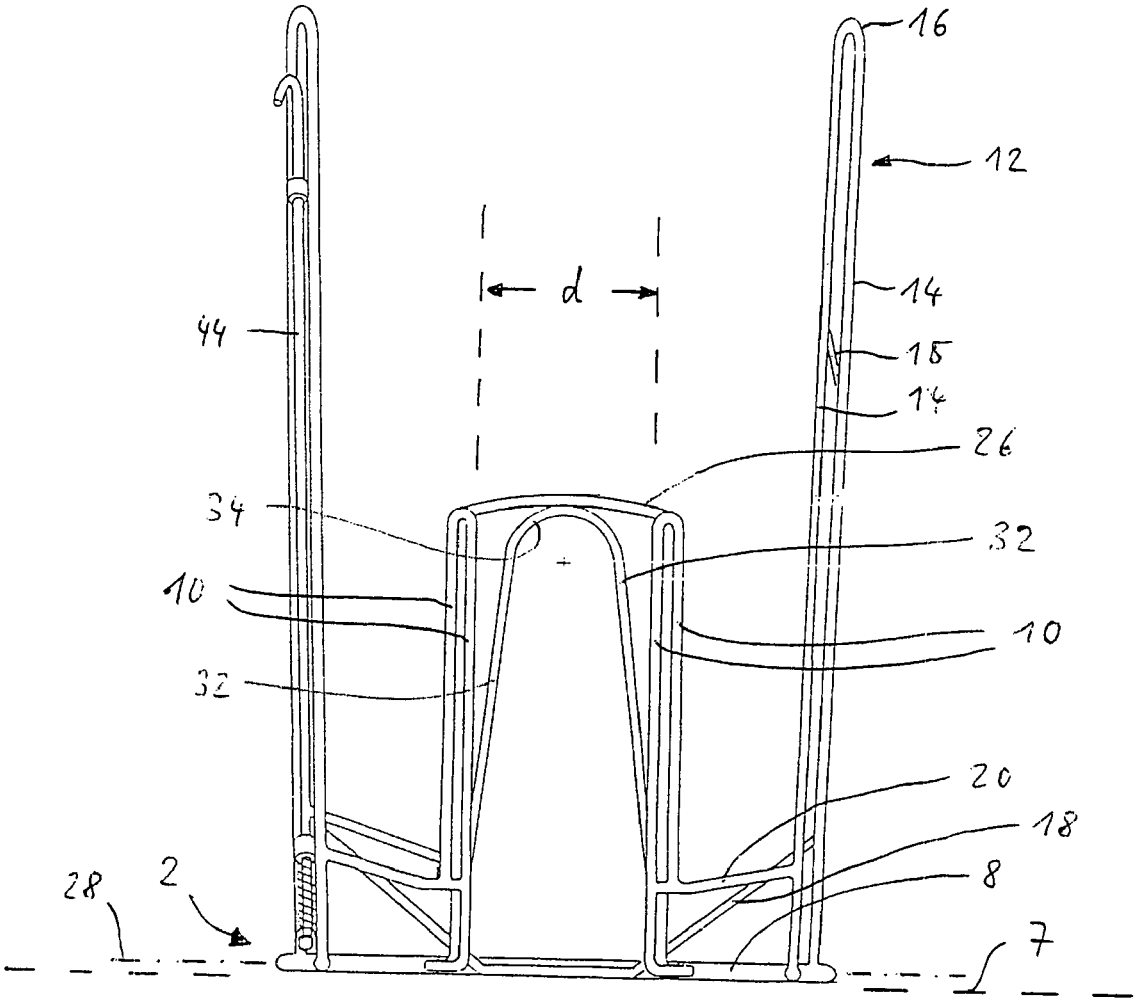
FIG. 3 shows a front view of the aid according to FIGS. 1 and 2.

In the locked state, the locking arm engages in the locking sleeve 58 by means of the locking projection 56 and holds the pivot portion 40 in its position lying against the first struts 10 (FIGS. 1, 3 and 5, FIG. 4: continuous lines). When the lever 46 is pulled in the direction 52, the locking projection 56 is withdrawn from the locking sleeve 58 and releases the pivot portion 40. The latter can then be moved in the direction of its entry position illustrated in FIG. 2 and indicated by dashed lines in FIG. 4.

The aid for pulling on stockings can be made from plastic, steel wire or the like.

Before use, the aid for pulling on stockings is placed with the base frame 2 resting on a support, such as the floor or a table. Then the compression stocking, with the tip in the interior of the tunnel-shaped region of the aid, i.e. between the first, second and third struts, is rolled outwards over the first struts 10 and the pivot portion 40, until only the foot portion remains in the interior of the tunnel-shaped region. In the process, the locking means 42 holds the pivot portion 40 in its folded up position.

In order to insert the foot into the foot portion of the compression stocking, the possibility of pivoting the pivot portion 40 now offers the advantage that the pivot portion 40 can be moved completely or partially into its folded-down position, as a result of which the stocking can be expanded considerably. In this way, pulling on the stocking is made even easier, since the foot does not necessarily have to be moved into a stretched position aligned with the calf.

After the foot has been inserted into the foot portion of the compression stocking, the device is gripped with the hands by the handles 12 and then moved upwards to roll the stocking up the leg.

The distance between the first or second struts 10, 24 and the third struts 32 is chosen such that at least two, preferably three fingers can reach through, so that the edge of the stocking can be gripped sufficiently and rolled up. The distance d between the first struts 10 and the second struts 24 is adapted to the width of the stocking and thus corresponds to the width of the user's calf. The distance by which the third struts 32 are spaced apart is large enough for the user's heel to pass between them.

In one variant of the invention, the first, second and third struts could each be designed to be adjustable in length, or telescopic, so that they can be adapted to different body sizes or stocking lengths.

The design of the base frame 2 is merely intended as an example, since its only purpose is to keep the lower ends of the first, second and third struts in a defined position relative to one another and to enable the aid to be stood up.

As to the rest, the distance of the struts from one another and the diameter of the hoops or arcuate portions used depends on the width of the stocking to be pulled on.

| List of reference numerals | |
|---|---|
| 2 | Base frame |
| 4 | Base leg |
| 6 | Side leg |
| 7 | Base plane |
| 8 | Retaining projection |
| 10 | First strut |
| 12 | Handle |
| 14 | Strut |
| 15 | Cross-strut |
| 16 | Arcuate portion |
| 18, 20 | Reinforcement strut |
| 24 | Second strut |
| 26 | Hoop |
| 28 | Pivot axis |
| 30 | Bent end portion |
| 32 | Third strut |
| 34 | Arcuate portion |
| 36 | Bent portion |
| 40 | Pivot portion |
| 42 | Locking means |
| 44 | Operating rod |
| 46 | Lever |
| 48 | Guide sleeve |
| 50 | Compression spring |
| 52 | Direction |
| 54 | Locking arm |
| 56 | Locking projection |
| 58 | Locking sleeve |
| d | Distance |
| α | Angle |
| β | Angle |
| ϕ | Angle |

The invention claimed is:

1. An aid for pulling on stockings, comprising:

a base frame (2) comprising two side legs and a base leg extending between the two side legs, the base frame contained within a base plane, two retaining projections connected at a first end to the two side legs and extending inwardly from the two side legs towards one another in the base plane, each of said retaining projections comprising hollow openings at a second end opposite to the first end two parallel first struts (10), said first struts (10) being fixedly attached at their lower ends to the base frame (2), said first struts (10) being spaced mutually apart and each having a free upper end, and two parallel second struts (24), which are spaced mutually apart by a distance (d) and whose upper ends are connected by an arcuate hoop (26), said second struts comprising receiving end portions (30) bent to extend in opposite directions from one another, and configured to be inserted into the hollow openings of the retaining projections, wherein said second struts (24) are pivotably mounted to the respective ones of the retaining projections when inserted into the hollow openings of the retaining projections about a pivot axis (28), the pivot axis (28) extending in alignment with the retaining projection in the base plane, said pivot axis running transversely to a longitudinal direction of said second struts (24), and wherein said second struts (24) are pivotable about the pivot axis between a first closed position, in which they are disposed adjacent and parallel to said first struts (10) and are folded back toward the first struts (10), and a second open position, in which they are disposed at a V-shaped angle ($\alpha$) with respect to said first struts (10).

2. An aid for pulling on stockings as claimed in claim 1, wherein at least one of said first struts (10) and said second struts (24) are each spaced 6 cm to 15 cm apart from one another.

3. An aid for pulling on stockings as claimed in claim 1, wherein said base frame (2) is U or C-shaped (4, 6).

4. An aid for pulling on stockings as claimed in claim 1, wherein said first struts (10) are arranged to be sloping at an angle of about 90° to 60° to said base frame (2).

5. An aid for pulling on stockings as claimed in claim 3, further comprising handles (12) disposed on said base frame (2).

6. An aid for pulling on stockings as claimed in claim 5, wherein each handle (12) is designed in the form of an elongate, reverse U-shaped hoop, which extends upwards from said base frame (2).

7. An aid for pulling on stockings as claimed in claim 1, wherein said hoop (26) connecting said second struts (24) extends in a plane parallel to the base plane (7) or at an angle thereto.

8. An aid for pulling on stockings as claimed in claim 1, wherein third struts (32) are disposed at a distance from said second struts (24), and, with said second struts (24), form edge lines of a tunnel-shaped region.

9. An aid for pulling on stockings as claimed in claim 8, wherein said tunnel-shaped region is semicylindrical or semiconical.

10. An aid for pulling on stockings as claimed in claim 1, further comprising a releasable locking means for locking said second struts (24) in the first position.

11. An aid for pulling on stockings as claimed in claim 10, wherein said locking means has an operating grip (46), which is disposed in the region of a handle (12).

* * * * *